US008876280B2

(12) United States Patent
Ishikawa et al.

(10) Patent No.: US 8,876,280 B2
(45) Date of Patent: Nov. 4, 2014

(54) PRINTING APPARATUS

(71) Applicant: Canon Kabushiki Kaisha, Tokyo (JP)

(72) Inventors: Tetsuya Ishikawa, Yokohama (JP); Atsushi Saito, Yokohama (JP); Shinya Asano, Tokyo (JP); Takatoshi Nakano, Yokohama (JP); Yutaka Kano, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/955,138

(22) Filed: Jul. 31, 2013

(65) Prior Publication Data

US 2014/0043394 A1 Feb. 13, 2014

(30) Foreign Application Priority Data

Aug. 9, 2012 (JP) ..... 2012-177533

(51) Int. Cl.
*B41J 2/01* (2006.01)
*B41J 2/14* (2006.01)
*B41J 3/60* (2006.01)

(52) U.S. Cl.
CPC *B41J 2/1433* (2013.01); *B41J 3/60* (2013.01); *B41J 2/14* (2013.01)
USPC ..... 347/104; 347/40

(58) Field of Classification Search
USPC ..... 347/40, 42–44, 101, 104–106
See application file for complete search history.

(56) References Cited

U.S. PATENT DOCUMENTS 8,328,311 B2 12/2012 Nakano et al.
2006/0164463 A1* 7/2006 Baker ..... 347/40
2008/0218547 A1 9/2008 Takamiya et al.

FOREIGN PATENT DOCUMENTS

JP 2010-064389 A 3/2010

* cited by examiner

*Primary Examiner* — Juanita D Jackson
(74) *Attorney, Agent, or Firm* — Fitzpatrick, Cella, Harper & Scinto

(57) ABSTRACT

An embodiment of this invention is directed to a printing apparatus capable of providing an output result without a printing density difference between two surfaces in two-sided printing. In the printing apparatus, one subtank is provided for each type of ink. The nozzles of printheads that receive inks supplied from the subtank and are used for printing of the front surface of a printing sheet and printing of the back surface, respectively, are aligned to almost the same level in the vertical direction, thereby making the water head pressures match.

11 Claims, 6 Drawing Sheets

PRINTING APPARATUS

BACKGROUND OF THE INVENTION

1. Field of the Invention

The present invention relates to a printing apparatus and, more particularly, to a printing apparatus than prints the two surfaces of a printing sheet using dedicated inkjet printheads.

2. Description or the Related Art

In general, a printing apparatus functioning as a printer or the printing unit of a copying machine or facsimile apparatus forms an image (including a character, symbol, and the like) on a sheet-like printing medium such as a paper, cloth, or plastic sheet using a printhead based on image information. The printing methods of printing apparatuses can be classified into a serial printing method and a full-line printing method by the type of the printhead used, in serial printing, an image is printed by alternately repeating an operation or printing while moving a serial printhead along a printing medium in a predetermined, direction (main scanning direction) and an operation of conveying the printing medium at a predetermined pitch in a direction (sub-scanning direction) perpendicular to the main scanning direction. On the other hand, in full-line printing, an image is printed by conveying a printing medium while printing one line at once using a full-line printhead. Printing apparatuses can be classified into, for example, an inkjet printing apparatus, a thermal transfer printing apparatus, an electrophotographic printing apparatus, a thermo-sensitive printing apparatus, and a wire dot printing apparatus by the printing method.

Especially, inkjet printing apparatuses using a full-line printhead feature a high printing speed and are widespread as output devices mainly used for business purposes. There has also been proposed an arrangement including printheads dedicated to print the front and back surfaces to speed up two-sided printing. An arrangement that provides one subtank in correspondence with each ink type regardless of the number of printheads used for downsizing and cost reduction is described in, for example, paragraph [0083] and FIG. 8 of Japanese Patent Laid-Open No. 2010-64389.

In the conventional inkjet printing apparatus, however, the water head difference between the printhead connected to one subtank and used to print the front surface of a printing sheet and the printhead used to print the back surface generates a negative pressure difference in the heads, leading to the difference in the ink discharge amount. To solve this problem, the ink supply channel of the printhead having a smaller water head difference is made to have a smaller sectional area than that, of the other ink supply channel, thereby generating a difference in the resistance to flow of ink and stabilising the negative pressures in both printheads.

However, in this arrangement, the resistance to flow of ink is proportional to the square of the flow velocity of ink. For this reason, the same negative pressure can be generated in both printheads only at a specific ink flow rate. When the print data amount changes, the ink amount to be consumed changes, and the Ink flow rate chances. Hence, a density difference between images printed on the two surfaces of the printing sheet might occur, depending on the image.

SUMMARY OF THE INVENTION

Accordingly, the present invention is conceived as a response to the above-described disadvantages of the conventional art.

For example, a printing apparatus according to this invention is capable of performing satisfactory printing without causing any density difference between two surfaces when printing the two surfaces of a sheet-like printing medium.

According to one aspect of the present invention, there is provided a printing apparatus capable of performing two-sided printing for causing a first printhead to discharge ink and print a front surface of a printing medium and causing a second printhead to discharge ink and print a back surface of the printing medium, comprising: an ink tank that contains ink to be supplied to the first printhead and the second printhead; and an ink supply channel that supplies ink from the ink tank to the first printhead and the second printhead, wherein the first printhead and the second, printhead are attached to the printing apparatus such that a nozzle array that discharges ink of the first printhead and a nozzle array that discharges ink of the second printhead are aligned to almost the same level in a vertical direction.

According to another aspect of the present invention, there is provided a printing apparatus comprising: a first printhead that has a first orifice surface for discharging ink and prints a first surface of a printing medium by discharging ink; an ink containing unit that contains ink to be supplied to the first printhead, wherein a liquid surface of ink contained in the ink containing unit is arranged at a position lower than the first orifice surface in a vertical direction; and a second printhead that has a second orifice surface for discharging ink and prints a second surface of the printing medium by discharging ink supplied from the ink containing unit, wherein the second orifice surface is arranged at a position approximately equal to the first orifice surface in the vertical direction.

The invention is particularly advantageous since the two surfaces of a sheet-like printing medium can always be printed at the same density regardless of print data.

Further features of the present invention will become apparent from the following description of exemplary embodiments (with reference to the attached drawings).

DESCRIPTION OF THE EMBODIMENTS

Figure 1:
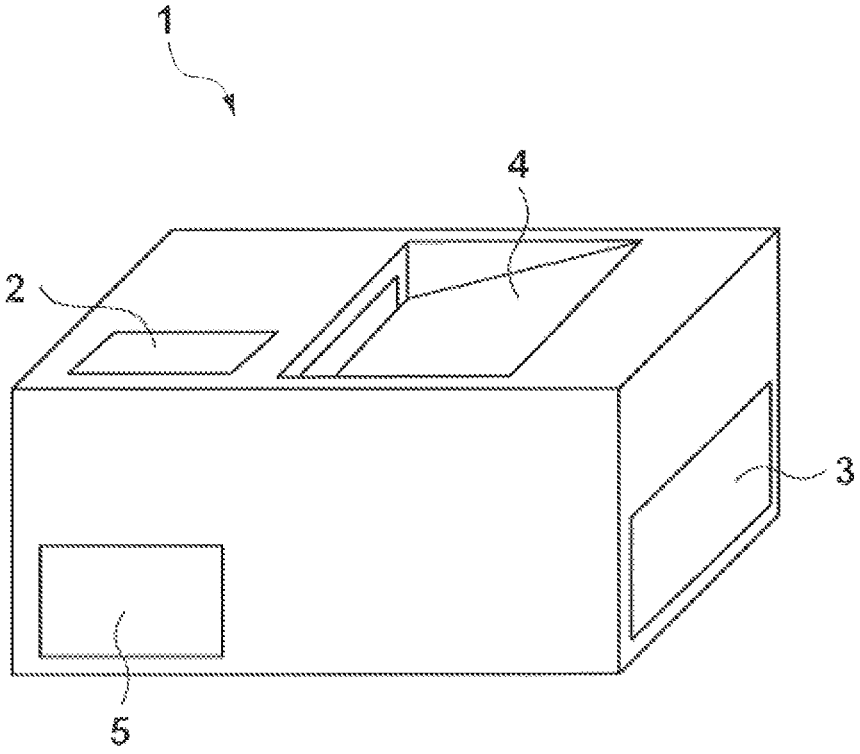
FIG. 1 is a perspective view showing the outer appearance of an inkjet printing apparatus according to an exemplary embodiment of the present invention.

Exemplary embodiments of the present invention will now be described in detail in accordance with the accompanying drawings. Note that the same reference numerals denote the same parts already described, and a description thereof will not be repeated.

In this specification, the terms “print” and “printing” not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

Further, a "nozzle" generically means an ink orifice or a liquid channel communicating with it, and an element for generating energy used to discharge ink, unless otherwise specified.

A board (head substrate) for a printhead to be used below indicates not a simple substrate made of silicon but an arrangement provided with elements, interconnections, and the like.

"On the substrate" not only simply indicates above the element substrate but also indicates the surface of the element substrate and the inner side of the element substrate near the surface. In the embodiment(s) of the present invention, "built-in" is a term not indicating simply arranging separate elements on the substrate surface as separate members but indicating integrally forming and manufacturing the respective elements on the element substrate in, for example, a semiconductor circuit manufacturing process.

FIG. 1 is a perspective view showing the outer appearance of an inkjet printing apparatus that performs printing using a full-line printhead (to be referred to as a printhead hereinafter) according to an exemplary embodiment of the present invention.

As shown in FIG. 1, an inkjet printing apparatus (to be referred to as a printing apparatus hereinafter) 1 is provided with an operation, panel 2, and includes a detachable feed cassette 3 and a discharge tray 4. An interchangeable ink tank can be detached by opening a tank exchange door 5.

Figure 2:
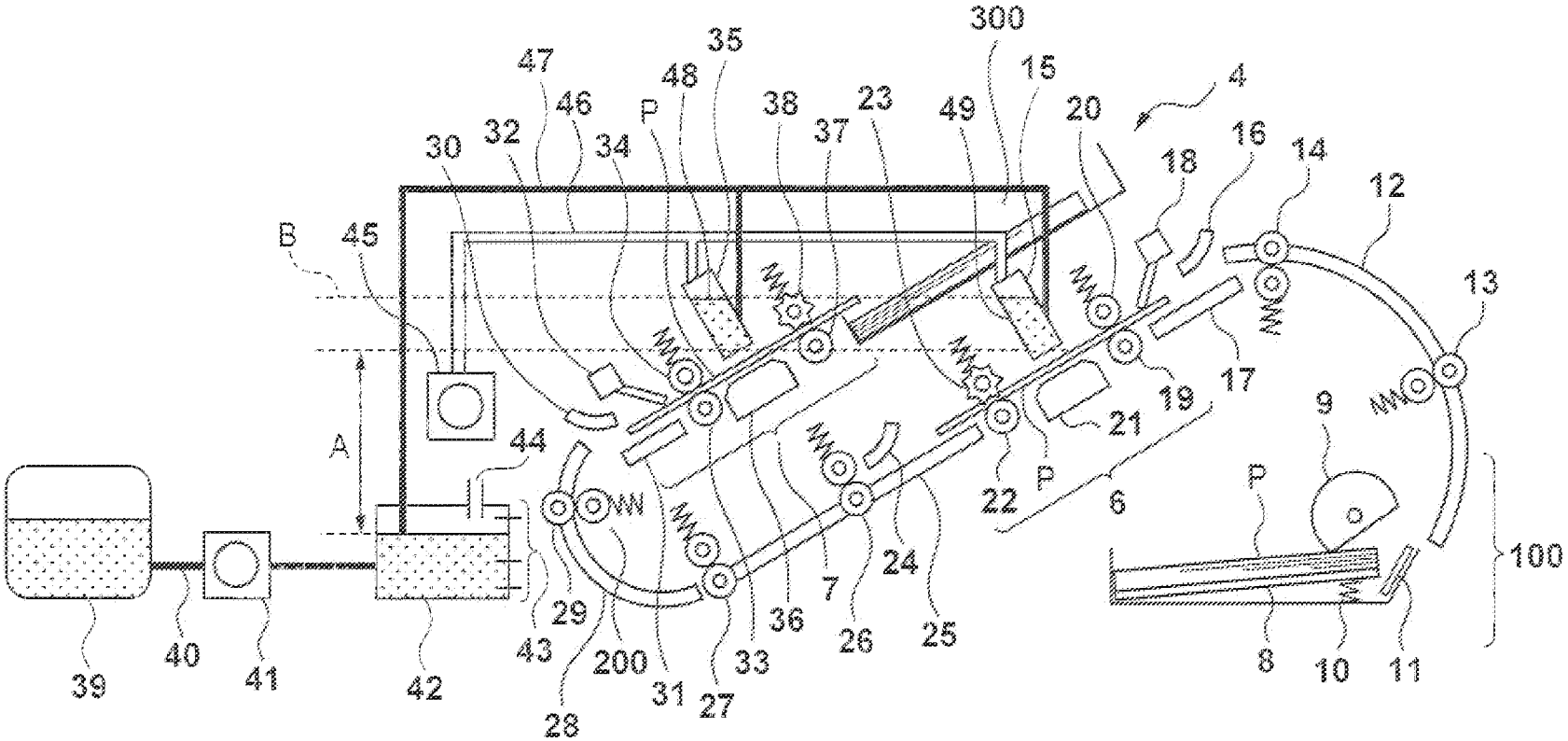
FIG. 2 is a schematic longitudinal sectional view of the printing apparatus shown in FIG. 1.

FIG. 2 is a longitudinal sectional view schematically showing the conveyance mechanism and the printing mechanism of the printing apparatus 1.

The printing apparatus 1 includes a feed unit 100, a first printing unit 6, a U-turn conveyance unit 200, a second, printing unit 7, and a discharge unit 300 sequentially from the upstream side with respect to the conveyance direction of a printing medium.

The arrangement of a compact conveyance mechanism that has a high volume efficiency and reduces the installation area of the printing apparatus 1 while applying the present invention will also be described below.

The feed unit 100 is configured to start a feed operation by driving a pressure plate 8 on which sheet-like printing sheets P are stacked and a feed roller 9 chat feeds the printing sheet P. The pressure plate 8 can pivot about the pivot shaft and is biased against the feed roller 9 by a pressure plate spring 10. A portion of the pressure plate 8 facing the feed roller 9 is provided with a friction pad (not shown) made of synthetic leather or the like and having a large friction coefficient to prevent erroneous conveyance of multiple printing sheets P.

A portion of the feed cassette 3 butting against the leading edges of the printing sheets P is provided with a separation member 11 formed from, for example, a material such as synthetic leather having a large friction coefficient or a knurled resin component so as to separate each of the stacked printing sheets P. Note that the butting/spacing the pressure plate 8 against/apart from the feed roller 9 is performed by a release cam (not shown). In a feed standby state, the release cam presses the pressure plate 8 down to a predetermined position, and the pressure plate and the printing sheers P stacked on it are spaced apart from the feed roller 3. When the feed roller 9 and the release cam are driven in this state, the release cam cancels the spacing apart of the pressure place. As the feed roller 9 rotates, the printing sheet P is picked up, and one sheet is separated by the separation member 11.

Subsequently, the printing sheet P is turned over while being sandwiched by conveyance roller pairs 13 and 14 each formed from a conveyance roller and a pinch roller biased by a spring through a first U-turn conveyance guide 12 serving as the first turn over conveyance mechanism of the printing sheet, and conveyed to the first printing unit 6. The first U-turn conveyance guide 12 is used to reduce the installation area of the printing apparatus 1, and prevents the installation area of the apparatus with respect to the feed/conveyance direction from becoming long. Note that, the circumference of the feed roller 9 is designed, to obtain a conveyance amount enough to feed the printing sheet P to the first conveyance roller (to be described later) by one rotation. Hence, every time one printing sheet P is fed, the feed roller 9 stops after one rotation. When the feed roller 9 is spaced apart from the printing sheet P and shifts to the standby state again, the driving force is cut off.

In the first printing unit 6, the printing sheer P is guided by a first upper guide 16 and a first lower guide 17 and fed toward a first sheet sensor 18. The first sheet sensor 18 detects the leading edge position of the fed printing sheet P. The first sheet sensor 18 is formed from a transmissive photointerrupter and a pivotal sensing lever integrated with a light-shielding flag.

Note that in this embodiment, the sensing lever is made long to beep the photo interrupter away from the printing surface, and a cover member made of a resin and surrounding the photo interrupter is provided, thereby preventing occurrence of detection errors caused by sticking of ink mist floating in the apparatus.

Next, the printing sheet P is sandwiched by a first conveyance roller 19 and a first pinch roller 20 biased against it and conveyed to the first printing unit 6 including a first printhead 15. In the first printing unit 6, the printing sheet P is conveyed on a first platen 21. The discharge timing of the first printhead 15 is controlled based on the leading edge detection timing of the printing sheet P by the first sheet sensor 18. The printing sheer P with its front surface printed by the first printhead 15 is sandwiched by a first discharge roller 22 and a first conveyance spur 23 biased against it by a spring, and conveyed.

Next, the printing sheet P is conveyed to a second U-turn guide 28 that constitutes the second turn over conveyance mechanism of the printing sheet while being guided by an intermediate upper guide 24 and an intermediate lower guide 25 and sandwiched by conveyance roller pairs 26 and 27 each formed from a conveyance roller and a pinch roller biased by a spring. In the second U-turn guide 28, the printing sheet P is conveyed by a U-turn conveyance roller pair 29 formed from a conveyance roller and a conveyance spur biased by a spring. The U-turn mechanism is provided to reduce the installation area of the printing apparatus 1 and simultaneously raise the vertical position of the printing sheet up to the second printing unit 7.

The printing sheet P turned over by the U-turn conveyance is guided by a second upper guide 30 and a second lower guide 31. A second sheet sensor 32 detects the leading edge position. Next, the printing sheet P is sandwiched by a second conveyance roller 33 and a second pinch roller 34 formed from, for example, a spur biased by a spring and, conveyed to the second printing unit 7 including a second printhead 35. In the second printing unit 7, the printing sheet P is conveyed on a second platen 36. The discharge timing of the second printhead 35 is controlled based on the timing at which the second sheet sensor 32 has detected the leading edge position of the sheet. The sheet P with its back surface printed by the second printhead 35 is sandwiched by a second discharge roller 37 and a second conveyance spur 38 biased against it by a spring, and conveyed.

The printing sheet P with its two surfaces printed in the above-described manner is discharged to the discharge tray 4, and the printing ends.

Note that depending on the arrangement of the conveyance mechanism, making the printing sheet P U-turn again in the conveyance path from the second printing unit 7 to the discharge tray 4 may contribute to further size reduction of the printing apparatus 1. However, since the printing sheet that has undergone the two-sided printing often curls or undulates, which might result in conveyance errors ouch as jam. In addition, to prevent smear caused by stacking the printing sheets on the discharge tray 4, the printing sheets are desirably discharged and stacked with their second printing surfaces, that is, the surfaces printed by the second printing unit 7 immediately before discharge facing up.

For the above-described reasons, the conveyance path from the second printing unit 7 to the discharge tray 4 is formed from an almost flat conveyance path without a U-turn conveyance unit.

An ink supply subsystem according to the feature of this embodiment will be described here.

An ink tank 39 containing ink is detachable from the printing apparatus 1. The ink tank 39 is attached and thus connected to an ink supply channel 40. In this state, an ink supply pump 41 formed from a tube pump or the like is driven to supply the ink from the ink tank 39 to a sub tank 42. The ink supply timing is controlled based on the detection result of a water level sensor 43 including a plurality of electrodes and provided inside the subtank 42.

An atmospheric opening 44 is formed in the subtank 42. Hence, the water head pressure applied to the nozzles of the first printhead 15 and those of the second printhead 35 is determined by a water head difference A between the liquid surface of the ink in the subtank 42 and the nozzles. When the positions of the nozzle arrays in the printheads which receive the ink supplied from the same subtank are aligned to almost the same level in the vertical direction, the negative pressures applied to the nozzle arrays of the two printheads can be made to match.

Note that to obtain a water head pressure for appropriate ink discharge, the water head difference desirably falls within the range of almost 50 mm to 300 mm.

Ink supply to the two printheads 15 and 35 is performed by a suction pump 45. The suction pump 45 and the two printheads 15 and 35 are connected by a suction tube 46. Hence, when the suction pump 45 is driven to suck the air in the printheads, the ink in the subtank 42 is supplied into the two printheads through ink supply tubes 47. In the two printheads, vapor-liquid separation films 48 and 49 each functioning as a supply amount limiting portion are arranged at a position B in the two printheads. Hence, when the suction pump 45 is driven to suck the air in the upper air chamber, the air in the space under the vapor-liquid separation films is wholly sucked and removed through the vapor-liquid separation films so that the liquid surfaces of the inks reach the vapor-liquid separation films 48 and 19. For the vapor-liquid separation films, the withstand pressure to the passage of ink is set to be much higher than the suction pressure that can be generated by the suction pump 45. For this reason, even when she suction pump 45 is continuously driven, the ink is never supplied any more.

Note that in this embodiment, one suction pump is provided for all printheads and nozzle arrays. However, a dedicated suction pump may be provided for each nozzle array. In such an arrangement, a vapor-liquid separation film need, not always be used as a supply amount limiting portion. For example, a water level sensor including electrodes or the like may be provided in each printhead, and driving of the suction pump may be controlled based on the detection result.

Figure 3:
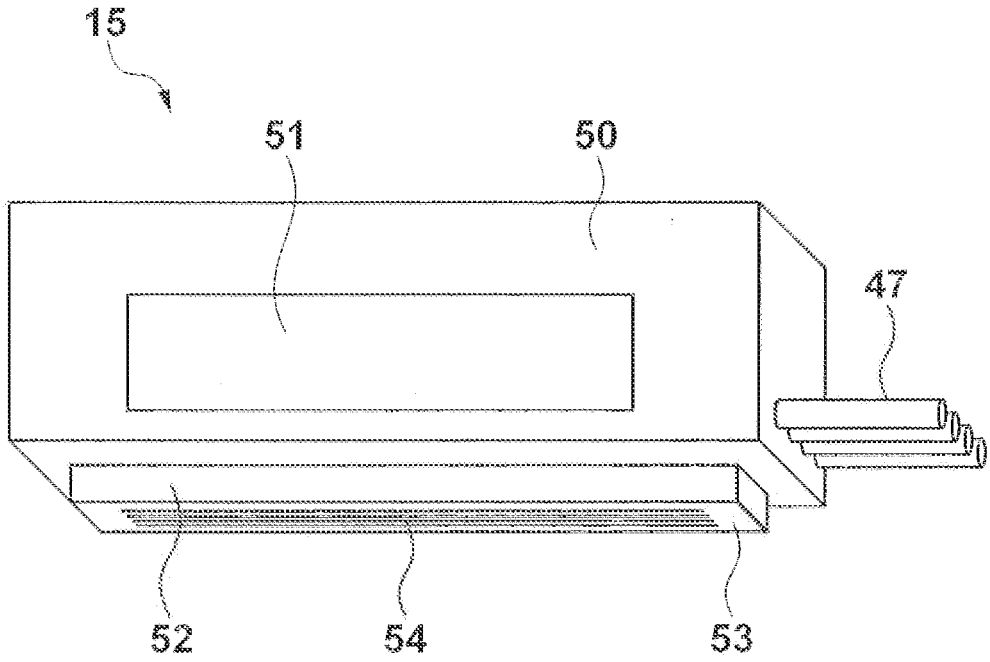
FIG. 3 is a perspective view showing the outer appearance of a first printhead shown in FIG. 2.

FIG. 3 is a perspective view showing the outer appearance of the first printhead 15 shown in FIG. 2.

As shown in FIG. 3, a case portion 50 is provided with an electrical connection portion 51 to the printing apparatus 1. In addition, a chip plate 52 made of a material such as alumina and incorporating an ink channel is provided on the bottom portion of the case portion 50. On the lower surface of the chip plate 12, a nozzle formation surface 53 is arranged, and nozzle arrays 54 including, for example, heaters for generating thermal energy to discharge ink droplets are formed.

Note that in this embodiment, a total of four nozzle arrays 51 are provided to discharge a total of four types of pigment inks including black, cyan, magenta, and yellow inks. Hence, a total of four subtanks 42 are provided.

Note that the second printhead 35 and its supply mechanism are the same as those of the first printhead 15, and a description thereof will be omitted.

Figure 4:
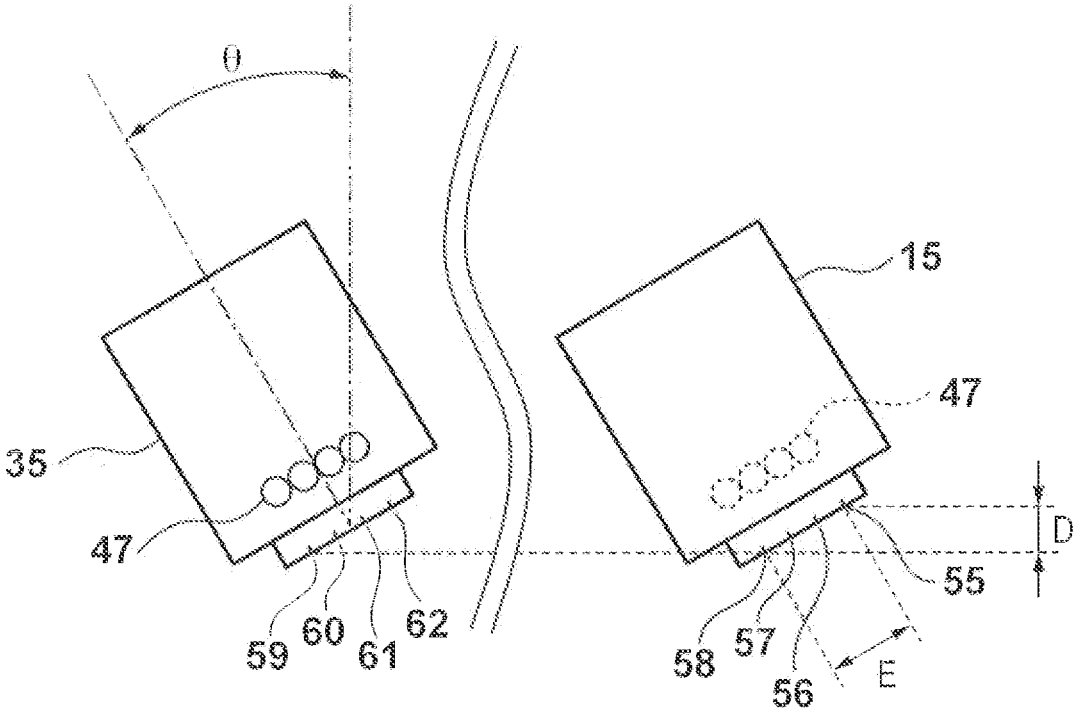
FIG. 4 is a view for explaining a tilt 9 of the printhead and the water head difference generated between nozzle arrays that discharge ink of the same color in two printheads.

FIG. 4 is a view for explaining a tilt angle θ of each printhead and the water head difference generated between the nozzle arrays that discharge ink of the same color in the two printheads.

Nozzle arrays that discharge black ink are nozzle arrays 55 and 59, nozzle arrays that discharge cyan ink are nozzle arrays 56 and 60, nozzle arrays that discharge magenta ink are nozzle arrays 57 and 61, and nozzle arrays that discharge yellow ink are nozzle arrays 58 and 62. The four types of nozzle arrays will also be referred so as a first nozzle array, a second nozzle array, a third nozzle array, and a fourth nozzle array, respectively. Although the first printhead 15 and the second printhead 35 have the same arrangement, the four types of nozzle arrays are arranged in opposite directions in FIG. 2.

This aims at preventing the color of a printed image from changing because of the change in the printing order of the black, cyan, magenta, and yellow inks on the printing sheet. Especially when inks mainly containing pigments are used as the color materials, as in this embodiment, the change in the color caused by the printing order is conspicuous.

On the other hand, in this embodiment, the nozzle formation surface 53 of the printhead is tilted by about 30° with respect to the horizontal plane. For this reason, a water head difference $D=(E)\times(\sin\theta)$ is generated between the nozzle arrays 55 and 59 that are arranged at the ends of the nozzle formation surfaces and discharge the black ink. In the arrangement of this embodiment, however, since the interval between adjacent nozzle arrays is about 2 mm, and the tilt angle θ is 30°, the water head difference D is as small as about 3 mm even for the nozzle arrays arranged at the ends to discharge the black ink, and the influence on the ink discharge amount is very little.

On the other hand, when, for example, dye inks whose planting order hardly affects the color of a printed image are used, the order of colors to be printed need not be taken into consideration.

Figure 5A:
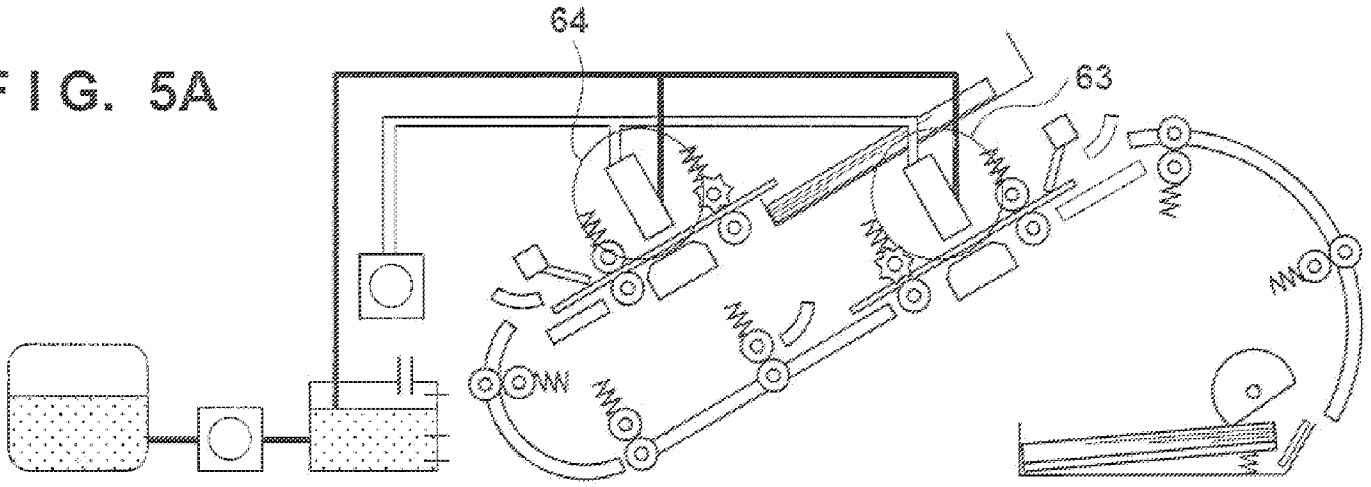
FIGS. 5A and 5B are views showing an example in which the nozzle arrangement order in the two printheads is different from that of the example shown in FIG. 4.
Figure 5B:
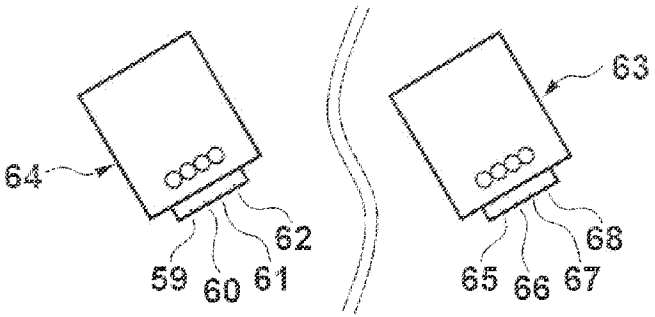

FIGS. 5A and 5B are views showing an example in which the nozzle arrangement order in the two printheads is different from that of the example shown in FIG. 4.

FIG. 5A is a longitudinal sectional view of the printing apparatus 1, and FIG. 5B is a partial enlarged view of two printheads 63 and 64 mounted in the printing apparatus shown in FIG. 5A. In the two printheads 63 and 64, nozzle arrays that discharge black ink are nozzle arrays 59 and 65, nozzle arrays that discharge cyan ink are nozzle arrays 60 and 66, nozzle arrays that discharge magenta ink are nozzle arrays 61 and 67, and nozzle arrays that discharge yellow ink are nozzle arrays 62 and 68.

As shown in FIG. 5B, the water head difference between the nozzle arrays may be eliminated, by arranging the nozzle arrays of the two printheads in the same direction, and the order of the colors of inks to be printed may be reversed in the two printheads.

Hence, according to the above-described embodiment, the two printheads can be attached to the printing apparatus such that the positions of the nozzle arrays of the printheads are aligned to almost the same level in the vertical direction when the first printhead prints the front surface of the printing sheet, and the second printhead prints the back surface. This makes it possible to make the negative pressures applied, to the nozzle arrays of the two printheads match, and allows the two printheads to print the two surface of a printing sheet at the same density.

Another Embodiment

An arrangement in which neither the order of inks to be printed nor even a slight water head difference can be permitted will be described here.

Figure 6:
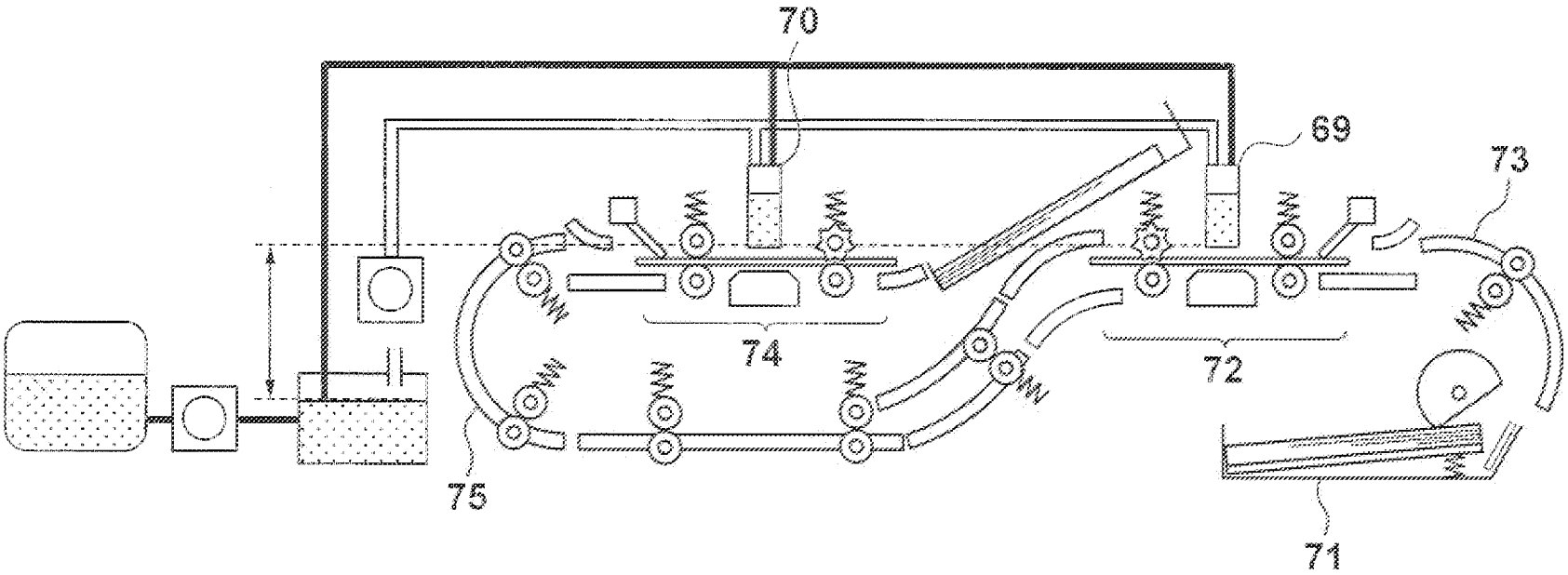
FIG. 6 is a view for explaining the attachment, positions of two printheads in a printing apparatus.

FIG. 6 is a view for explaining the attachment, positions of two printheads in a printing apparatus. According to the arrangement shown in FIG. 6, the nozzle formation surfaces (ink discharge surfaces) of a first printhead 69 and a second printhead 70 are flush with each other. This arrangement can eliminate the water head difference between the two printheads regardless of the ink color order.

The printheads used as the first printhead 69 and the second printhead 70 need not always be identical. Hence, printheads having different arrangements may be used.

Note that the printing sheet conveyance unit may have the same arrangement as that shown in FIG. 2 even when the two printheads are attached as shown, in FIG. 6. That is, a first U-turn conveyance unit 73 is provided between a feed unit 71 and a first printing unit 72, and a second U turn conveyance unit 75 is provided between the first printing unit 72 and a second printing unit 74, thereby constituting a printing apparatus that, has a small installation area and causes neither conveyance failures nor smear.

STILL OTHER EMBODIMENT

Figure 7:
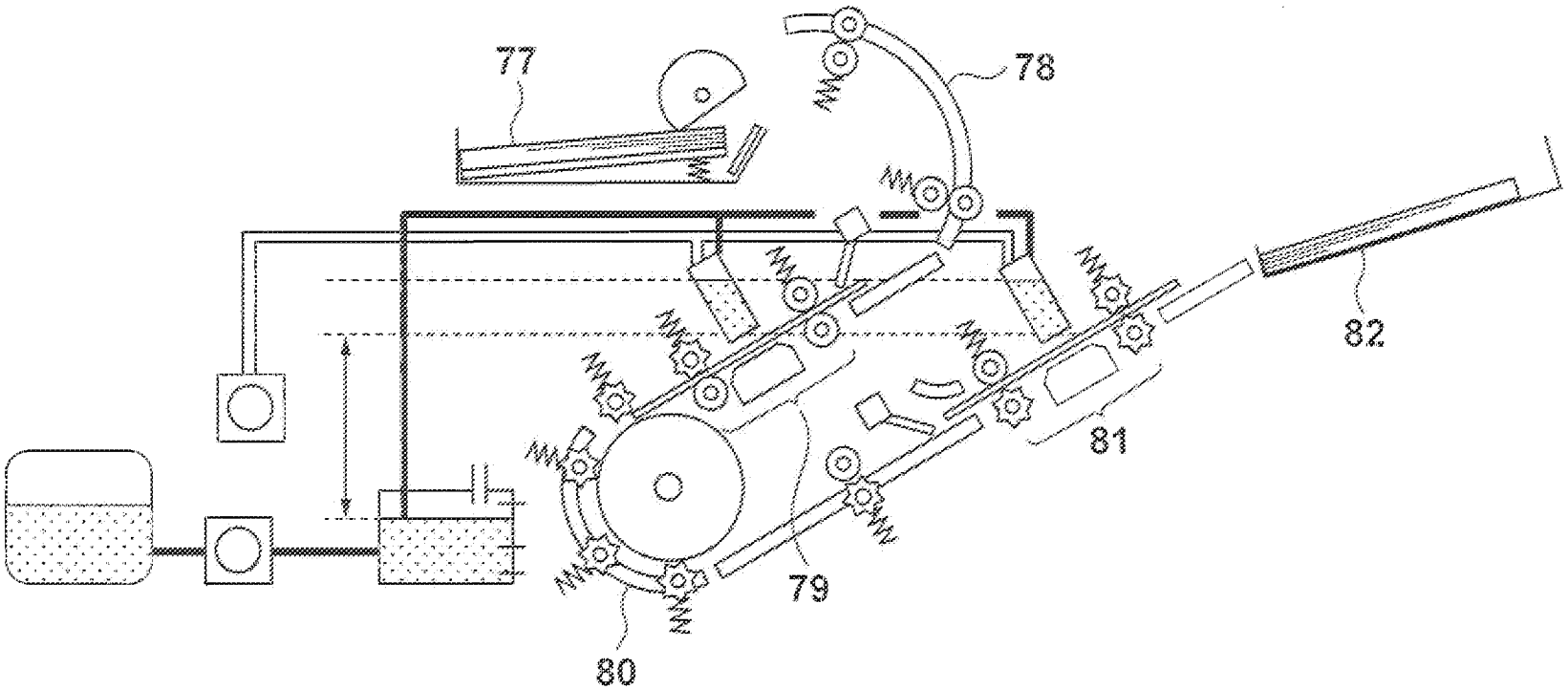
FIG. 7 is a longitudinal sectional view showing a printing apparatus so as to illustrate another example of a printing sheet conveyance mechanism.

In the above-described two embodiments, the conveyance mechanism is constituted such that the conveyance path rises from the feed unit to the discharge unit. However, the present invention is not limited to this. For example, a feed unit 77 may be provided above the two printing units so that the feed unit 77, a first U-turn conveyance unit 78, a second printing unit 79, a second U-turn conveyance unit 80, a second printing unit 81, and a discharge tray 82 are arranged as shown in FIG. 7.

While the present invention has been described with reference to exemplary embodiments, it is to be understood, that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-177533, filed Aug. 3, 2012, which is hereby incorporated by reference herein in its entirety.

What is claimed is:

1. A printing apparatus capable of performing two-sided printing for causing a first printhead to discharge ink end print a front surface of a printing medium and causing a second printhead to discharge ink and print a back surface of the printing medium, comprising:

an ink tank that contains ink to be supplied to the first printhead and the second printhead; and an ink supply channel that supplies ink from said ink tank to the first printhead and the second printhead, wherein the first printhead and the second printhead are attached to the printing apparatus such that a nozzle array that discharges ink of the first printhead and a nozzle array that discharges ink of the second printhead are aligned to almost the same level in a vertical direction.

2. The apparatus according to claim 1, wherein ink discharge surfaces of the first printhead and the second printhead have almost the same angle with respect to the vertical direction.

3. The apparatus according to claim 1, wherein ink discharge surfaces of the first printhead and the second printhead are substantially flush with each other.

4. The apparatus according to claim 1, further comprising:

a feed unit that feeds the printing medium;

a first turn over conveyance mechanism, provided with respect to a conveyance path of the printing medium on an upstream side of a position where the first printhead is provided, configured to turn over the printing medium; and a second turn over conveyance mechanism, provided with respect to the conveyance path of the printing medium between the position where the first printhead is provided and a position where the second printhead is provided, configured to turn over the printing medium.

5. The apparatus according to claim 1, wherein each of the first printhead and the second, printhead comprises a full-line printhead, the full-line printhead includes:

a first nozzle array in which a plurality of nozzles for discharging black ink are arranged;

a second nozzle array in which a plurality of nozzles for discharging cyan ink are arranged;

a third nozzle array in which a plurality of nozzles for discharging magenta ink are arranged; and a fourth nozzle array in which a plurality of nozzles for discharging yellow ink are arranged.

6. The apparatus according to claim 5, wherein in a case where the first printhead and the second printhead are attached to the printing apparatus, an arrangement order of the first nozzle array, the second nozzle array, the third nozzle array, and the fourth nozzle array in the first printhead is opposite to that of the first nozzle array, the second nozzle array, the third nozzle array, and the fourth nozzle array in the second printhead with respect to a conveyance direction of the printing medium upon printing.

7. The apparatus according to claim 6, wherein each of the black ink, the cyan ink, the magenta ink, and the yellow ink comprises pigment ink.

8. The apparatus according to claim 5, wherein in a case where the first printhead and the second, printhead are attached to the printing apparatus, an arrangement order of the first nozzle array, the second nozzle array, the third nozzle array, and the fourth nozzle array in the first printhead is the same as that of the first nozzle array, the second nozzle array, the third nozzle array, and the fourth nozzle array in the second printhead with respect to a conveyance direction of the printing medium upon printing.

9. The apparatus according to claim 8, wherein each of the black ink, the cyan ink, the magenta ink, and the yellow ink comprises dye ink.

10. A printing apparatus comprising:

a first printhead that has a first orifice surface for discharging ink and prints a first surface of printing medium by discharging ink;

an ink containing unit that contains ink to be supplied to said first printhead, wherein a liquid surface of ink contained in said ink containing unit is arranged at a position, lower than the first orifice surface in a vertical direction; and a second printhead that has a second orifice surface for discharging ink and prints a second surface of the printing medium by discharging ink supplied from said ink containing unit, wherein the second orifice surface is arranged at a position approximately equal to the first orifice surface in the vertical direction.

11. The apparatus according to claim 10, further comprising:

a feed unit configured to feed the printing medium so a position facing said first printhead;

a first turn over mechanism, provided in a path between said feed unit and said first printhead, configured to turn over the printing medium fed from said feed unit; and a second turn over mechanism, provided in the path between said first printhead and said second printhead, configured to turn over the printing medium printed by said first printhead.

* * * * *